US006544005B2

(12) United States Patent
Wade

(10) Patent No.: US 6,544,005 B2
(45) Date of Patent: Apr. 8, 2003

(54) DIAPHRAGM FOR A DIAPHRAGM PUMP

(75) Inventor: Duncan Wade, Sherwood Park (CA)

(73) Assignee: Wade Metal Products Limited, South Park (CA)

( * ) Notice: Subject to any disclaimer, the term of this patent is extended or adjusted under 35 U.S.C. 154(b) by 0 days.

(21) Appl. No.: 10/010,900

(22) Filed: Oct. 26, 2001

(65) Prior Publication Data

US 2002/0064468 A1 May 30, 2002

(30) Foreign Application Priority Data

Nov. 28, 2000 (CA) ..... 2327012

(51) Int. Cl.[7] ..... F04B 35/06

(52) U.S. Cl. ..... 417/233; 417/534; 417/412; 417/413.1; 92/23

(58) Field of Search ..... 417/413.1, 233, 417/229, 904, 334, 417, 412, 479, 559, 569, 571, 572; 92/34, 89–92

(56) References Cited

U.S. PATENT DOCUMENTS

| | | | | | |
|---|---|---|---|---|---|
| 2,328,970 | A | * | 9/1943 | Farquhar | 91/432 |
| 3,099,189 | A | * | 7/1963 | Blondiau | 92/23 |
| 3,206,159 | A | * | 9/1965 | Anderson et al. | 251/28 |
| 3,827,675 | A | | 8/1974 | Schuman | 356/85 |
| 3,830,596 | A | | 8/1974 | Kondo | 417/413 |
| 3,847,513 | A | | 11/1974 | Foster | 417/571 |
| 3,923,657 | A | | 12/1975 | Roser | 210/95 |
| 4,050,861 | A | | 9/1977 | Sakai et al. | 417/471 |
| 4,109,465 | A | | 8/1978 | Plen | 60/398 |
| 4,137,020 | A | * | 1/1979 | Ito et al. | 417/534 |
| 4,139,333 | A | | 2/1979 | Sipos | 417/63 |
| 4,148,682 | A | * | 4/1979 | Collins et al. | 156/416 |
| 4,167,162 | A | | 9/1979 | Akman | 123/117 |
| 4,170,439 | A | | 10/1979 | Hase | 417/413 |
| 4,179,244 | A | | 12/1979 | Marple | 417/273 |
| 4,329,123 | A | | 5/1982 | Kawabata et al. | 417/393 |
| 4,334,837 | A | | 6/1982 | Inada et al. | 417/393 |
| 4,483,665 | A | | 11/1984 | Hauser | 417/401 |
| 4,608,000 | A | | 8/1986 | Tominaga | 417/413 |
| 4,610,608 | A | | 9/1986 | Grant | 417/413 |
| 4,723,894 | A | | 2/1988 | Marx | 417/269 |
| 4,836,756 | A | | 6/1989 | Fukumoto | 417/394 |
| 4,859,152 | A | | 8/1989 | Kimura et al. | 417/63 |
| 4,877,378 | A | | 10/1989 | Saggers | 417/412 |
| 4,931,000 | A | | 6/1990 | Fleming, Jr. | 417/534 |
| 5,049,770 | A | | 9/1991 | Gaeth et al. | 310/89 |
| 5,052,904 | A | | 10/1991 | Itakura et al. | 417/363 |
| 5,137,430 | A | | 8/1992 | Alioto | 417/231 |
| 5,158,439 | A | | 10/1992 | Fukumoto | 417/394 |
| 5,308,230 | A | | 5/1994 | Moore | 417/394 |
| 5,339,645 | A | | 8/1994 | Siegel | 62/235.1 |
| 5,345,929 | A | | 9/1994 | Jansson et al. | 128/205.13 |
| 5,354,457 | A | | 10/1994 | Becchi | 210/170 |
| 5,360,323 | A | | 11/1994 | Hsieh | 417/413.1 |
| 5,366,358 | A | | 11/1994 | Grenci et al. | 418/55.4 |
| 5,419,687 | A | | 5/1995 | Adahan | 417/412 |
| 5,437,542 | A | | 8/1995 | Ewing | 417/258 |

(List continued on next page.)

*Primary Examiner*—Charles G. Freay
*Assistant Examiner*—Emmanuel Sayoc
(74) *Attorney, Agent, or Firm*—Davis & Bujold, P.L.L.C.

(57) ABSTRACT

A diaphragm for a diaphragm pump is in the form of a vehicle tire. The vehicular tire has a first mounting face, a second mounting face and a circumferential tread portion positioned between first mounting face and the second mounting face. A first sealing disk is secured to the first mounting face of the tire. A second sealing disk is secured to the second mounting face of the tire. An inlet valve positioned on either the first sealing disk or the second sealing disk. An outlet valve is positioned on either the first sealing disk or the second sealing disk.

3 Claims, 6 Drawing Sheets

U.S. PATENT DOCUMENTS

| | | | | | |
|---|---|---|---|---|---|
| 5,480,292 | A | | 1/1996 | Chevallier | 417/393 |
| 5,506,012 | A | * | 4/1996 | Wright et al. | 428/35.2 |
| 5,510,022 | A | | 4/1996 | Mullis | 210/170 |
| 5,529,467 | A | * | 6/1996 | Rometsch | 417/534 |
| 5,558,506 | A | | 9/1996 | Simmons et al. | 417/393 |
| 5,573,385 | A | | 11/1996 | Chevallier | 417/393 |
| 5,595,691 | A | | 1/1997 | Hsu | 216/120 |
| 5,772,413 | A | | 6/1998 | Oshidari | 417/472 |
| 6,345,963 | B1 | * | 2/2002 | Thomin et al. | 417/412 |
| 2002/0094285 | A1 | * | 7/2002 | Paolini et al. | 417/413.1 |

* cited by examiner

DIAPHRAGM FOR A DIAPHRAGM PUMP

FIELD OF THE INVENTION

The present invention relates to a diaphragm for a diaphragm pump

BACKGROUND OF THE INVENTION

If there is not sufficient oxygen in the water, fish will die. In order to aerate fish ponds, diaphragm pumps are secured to windmills. As the wind blows, the diaphragm of the diaphragm pump moves through a cycle in which first the diaphragm is expanded to draw in air and then the diaphragm is contracted to expel the air into the fish pond.

When the wind blows lightly, the diaphragm pump functions well. When the wind blows moderately, the diaphragm of the diaphragm pump experiences accelerated wear. When the wind blows strongly, the diaphragm of the diaphragm pump is rapidly destroyed if not disconnected.

SUMMARY OF THE INVENTION

What is required is a more robust form of diaphragm for a diaphragm pump.

According to the present invention there is provided a diaphragm for a diaphragm pump which is in the form of a vehicle tire. The vehicular tire has a first mounting face, a second mounting face and a circumferential tread portion positioned between first mounting face and the second mounting face. A first sealing disk is secured to the first mounting face of the tire. A second sealing disk is secured to the second mounting face of the tire. An inlet valve positioned on either the first sealing disk or the second sealing disk. An outlet valve is positioned on either the first sealing disk or the second sealing disk.

A great deal of engineering has gone into vehicular tires to ensure they are not subject to premature failure. These qualities of durability, enable the vehicular tire to function as an extremely robust form of diaphragm for a diaphragm pump. Some vehicular tires function better than others. There are very few diaphragm pumps that are large enough or powerful enough to function with a truck tire. In contrast, a trailer tire or a wheel barrow tire can be made to function with some models of diaphragm pump currently available.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
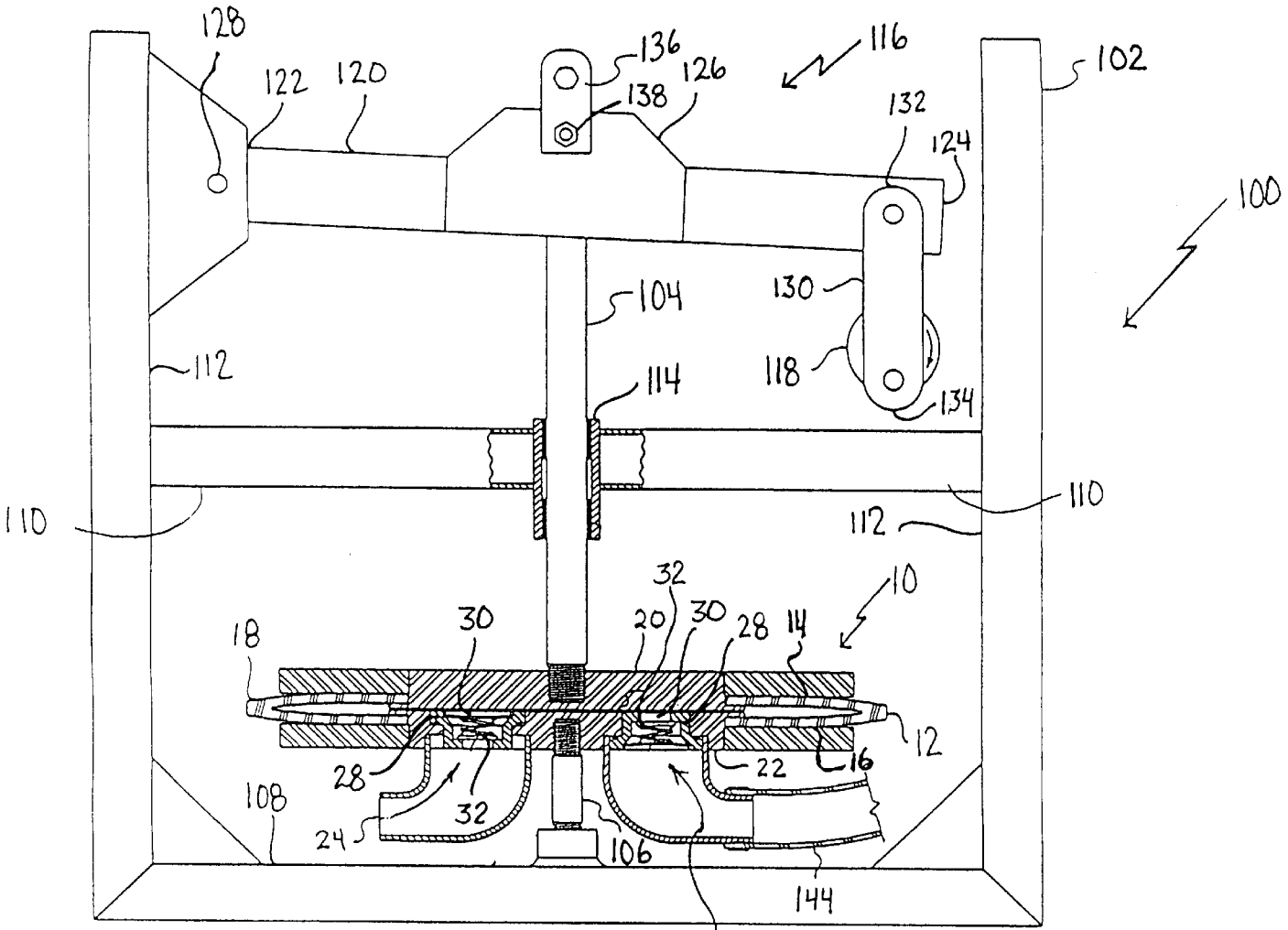
FIG. 1 is a side elevation view, in section, of a diaphragm pump equipped with a diaphragm constructed in accordance with the teachings of the present invention.

The preferred embodiment, a diaphragm for a diaphragm pump generally identified by reference numeral 10, will now be described with reference to FIGS. 1 through 6.

Structure and Relationship of Parts:

Referring to FIG. 1, diaphragm 10 includes a vehicular tire 12 that has a first mounting face 14, a second mounting face 16 and a circumferential tread portion 18 that is positioned between first mounting face 14 and second mounting face 16. A first sealing disk 20 is secured to first mounting face 14 of tire 12. A second sealing disk 22 is secured to second mounting face 16 of tire 12. An inlet valve, generally indicated by reference numeral 24, and an outlet valve, generally indicated by reference numeral 26, are positioned on second sealing disk 22. Inlet valve 24 and outlet valve 26 each have valve seat 28 and a valve member 30. Each valve member 30 is mounted on a spring 32. In the illustrated embodiment, both inlet valve 24 and outlet valve 26 are illustrated as being positioned on second sealing disk 22, however it will be appreciated that inlet valve 24 and outlet valve 26 can be positioned on either first sealing disk 20 or second sealing disk 22. It will also be appreciated that tire 12 that is used can be a trailer tire, a wheel barrow tire, or any other suitable tire.

Diaphragm 10 is installed in a diaphragm pump, generally indicated by reference numeral 100. Referring to FIG. 1, diaphragm pump 100 includes a housing 102, diaphragm 10, and a reciprocating member 104 that is attached to first sealing disk 20. Second sealing disk 22 is secured to a post 106 that extends vertically from bottom 108 of housing 102. Reciprocating member 104 moves first sealing disk 20 toward and away from second sealing disk 22 as reciprocating member 104 reciprocates. Support members 110 are provided that extend from sides 112 of housing 102 to support a sleeve 114. Sleeve 114 guides reciprocating member 104 during. reciprocating movement.

Figure 5:
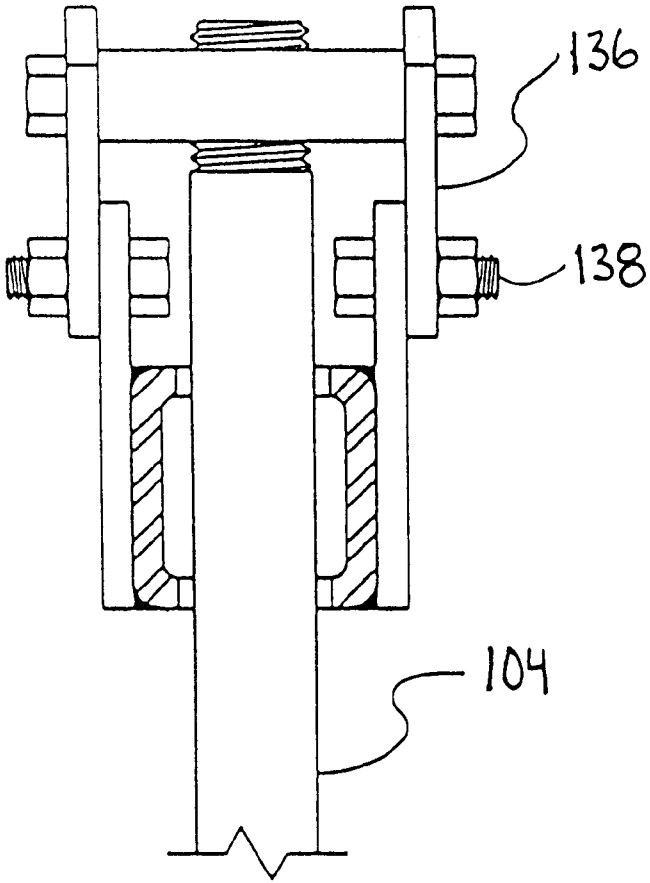
FIG. 5 is a detailed front elevation view, in section, of a portion of a motion converting linkage for the diaphragm pump illustrated in FIG. 1.

A motion converting drive linkage, generally indicated by reference numeral 116 is provided that converts rotary input motion of an input crank 118 to reciprocating motion of reciprocating member 104. Drive linkage 116 includes a bar 120 that extends inward horizontally from housing 102. Bar 120 has a first end 122, a second end 124 and a midsection 126. First end 122 of bar 120 is pivotally connected to side 112 of housing 102 at pivotal connection 128 in such a manner that bar 120 can pivot upward or downward. A connecting rod 130 is provided having a first end 132 and a second end 134. First end 132 of connecting rod 130 is pivotally connected to and extends vertically down from second end 124 of bar 120 while second end 134 of connecting rod 130 is connected to the perimeter of input crank 118. Referring to FIG. 5, reciprocating member 104 is secured to midsection 126 of bar 120 by a bracket 136 and bolts 138.

Operation:

The use and operation of diaphragm 10 will now be described with reference to FIGS. 1 through 6. Input crank 118 of diaphragm pump 100 is attached to an external device, preferably a windmill (not shown), that provides rotary input. Referring to FIGS. 1 through 4, rotary input motion causes input crank 118 to turn, which in turn causes connecting rod 130 to be lifted up and down. As connecting rod 130 is lifted up and down, connecting rod 130 causes second end 124 of attached bar 120 to move up and down. When second end 124 of bar 120 moves up and down, bar 120 causes reciprocating member 104 that is attached to midsection 126 of bar 120 to also move up and down in a reciprocating motion so as to expand or compress diaphragm 10.

Figure 2:
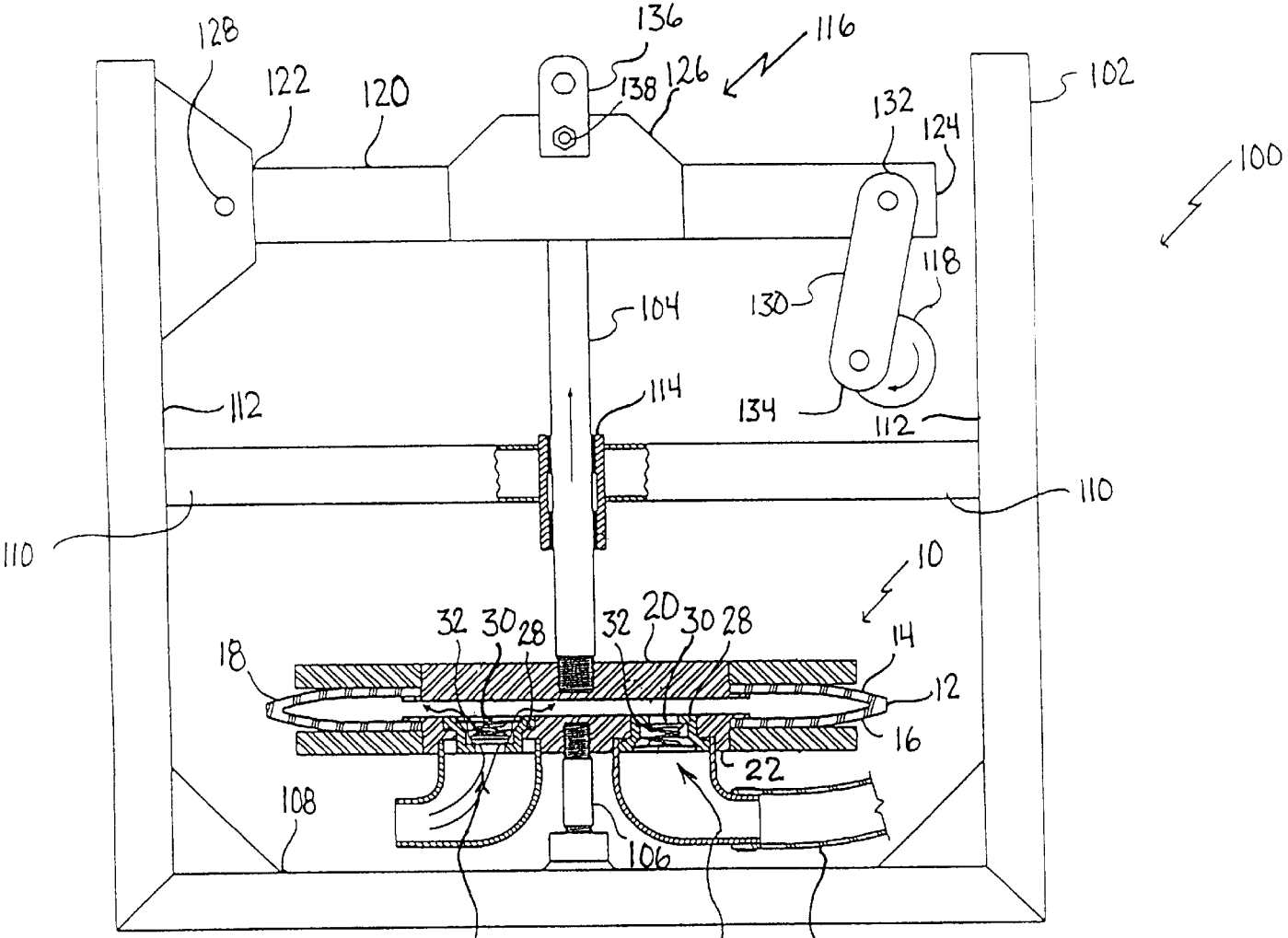
FIG. 2 is a side elevation view, in section, of the diaphragm pump illustrated in FIG. 1, with the diaphragm commencing the intake phase of its operating cycle.
Figure 3:
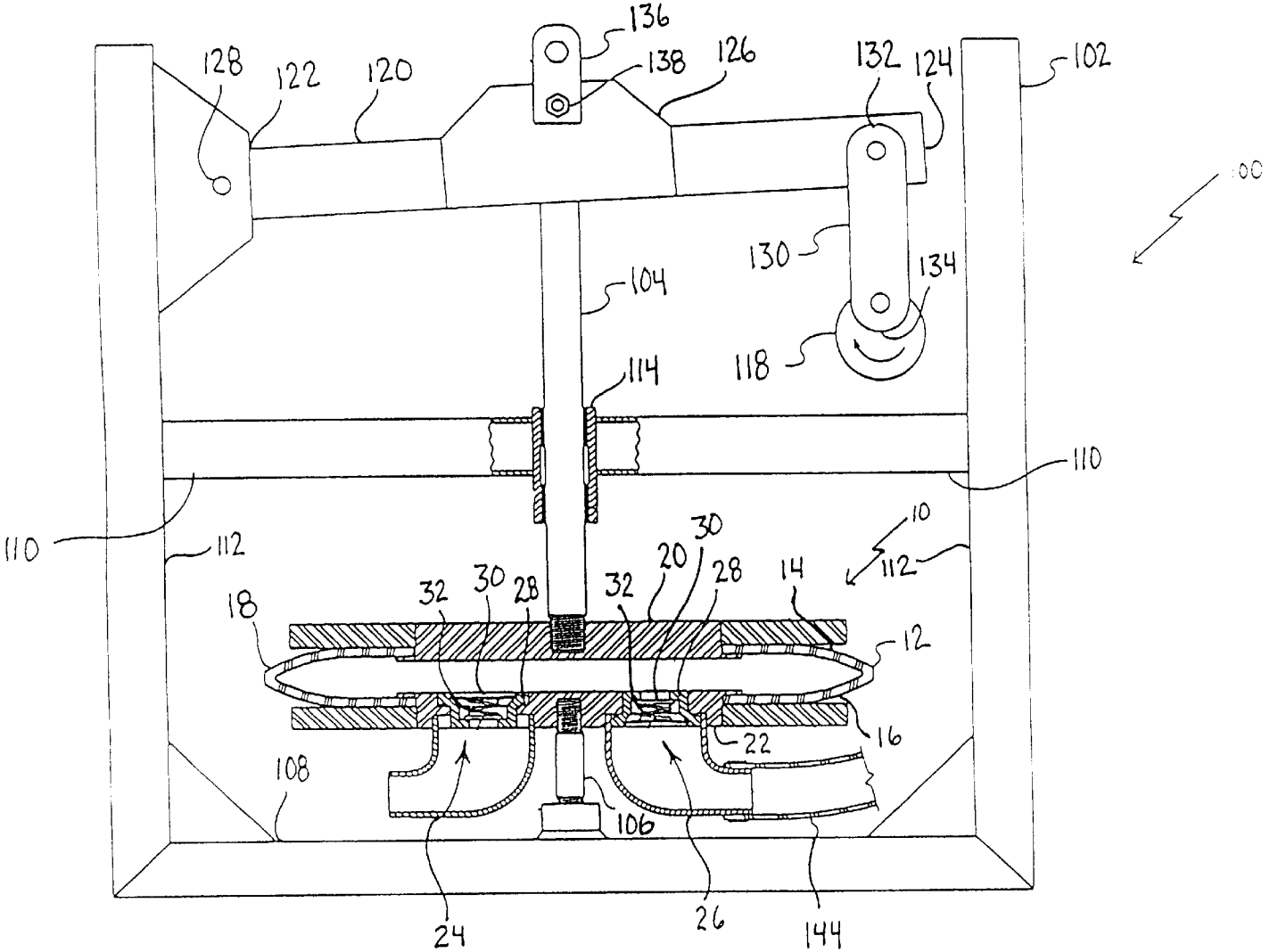
FIG. 3 is a side elevation view, in section, of the diaphragm pump illustrated in FIG. 1, with the diaphragm fully extended in the intake phase of its operating cycle.
Figure 4:
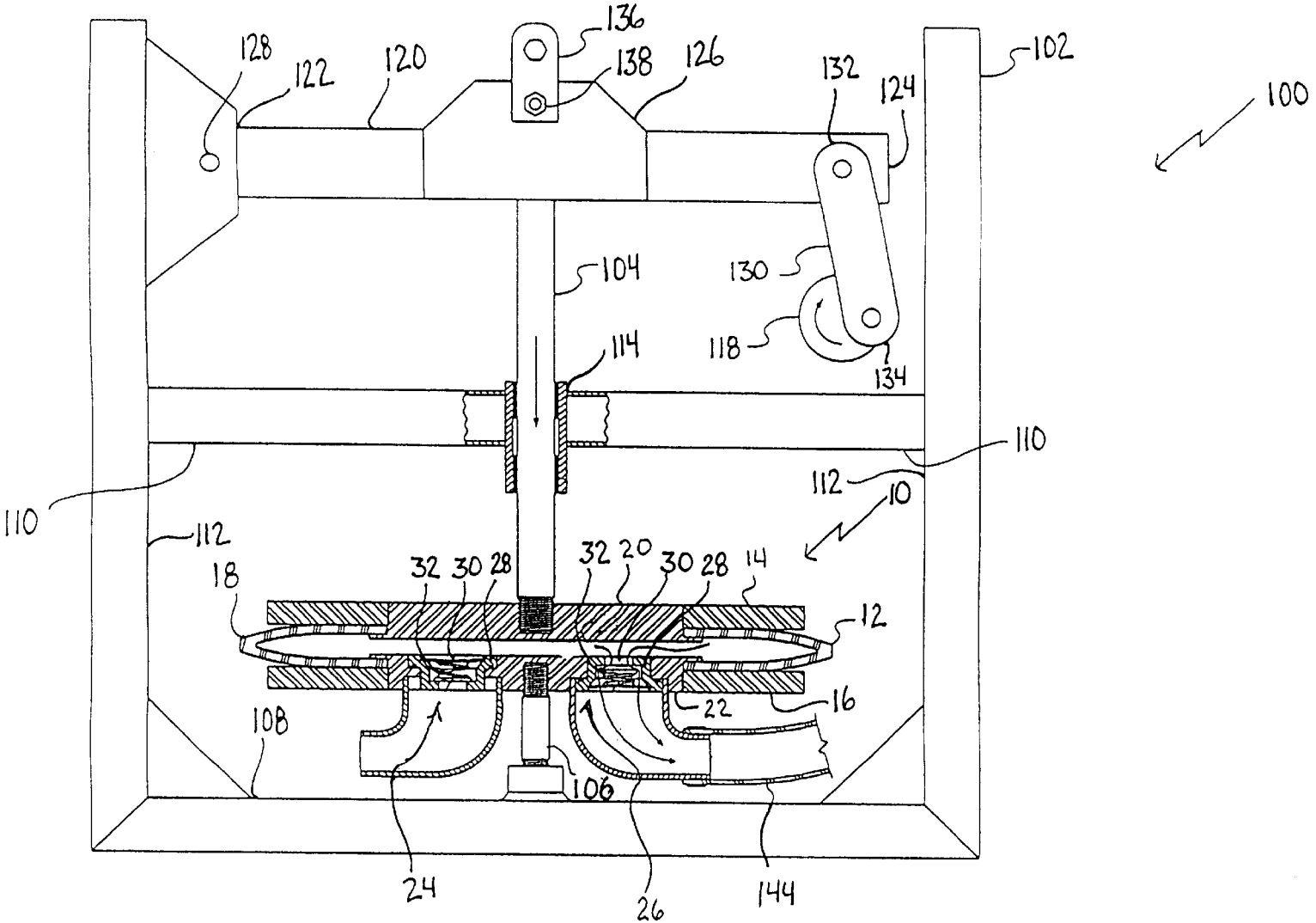
FIG. 4 is a side elevation view, in section, of the diaphragm pump illustrated in FIG. 1, with the diaphragm in the exhaust phase of its operating cycle.
Figure 6:
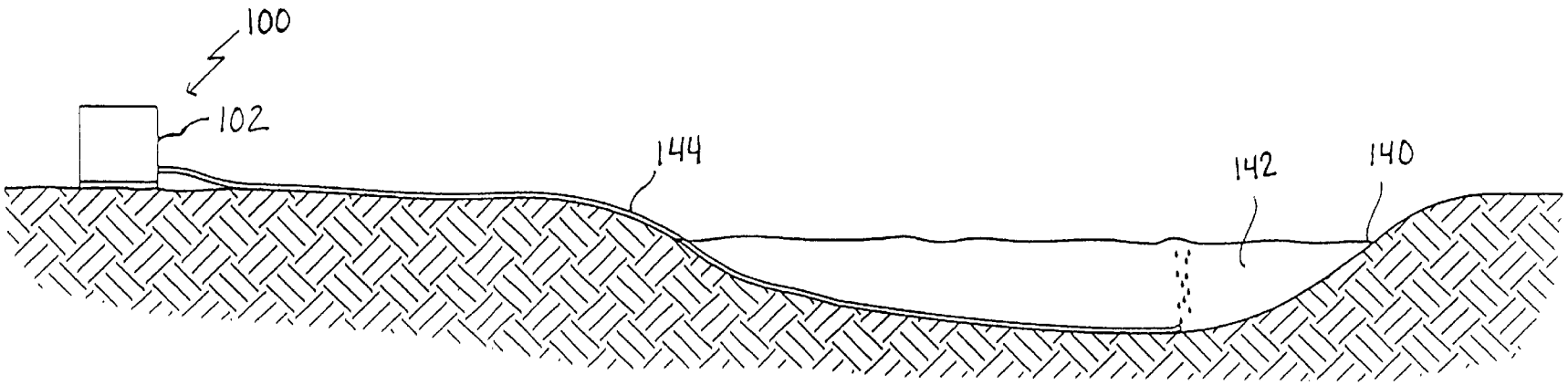
FIG. 6 is a side elevation view, in section, of a fish pond in which is installed the diaphragm pump illustrated in FIG. 1.

Diaphragm 10 moves through a cycle in which diaphragm 10 is expanded to draw in air and then diaphragm 10 is contracted to expel the air. Referring to FIG. 2, as first sealing disk 20 and second sealing disk 22 are moved away from each by other reciprocating member 104, diaphragm 10 is expanded drawing air through inlet valve 24 into tire 12. During expansion of diaphragm 10, the inflow of air compresses spring 32 of inlet valve 24 moving valve member 30 out of valve seat 28 to allow air to flow into diaphragm 10 while spring 32 in outlet valve 26 biases valve member 30 into valve seat 28 to prevent air from escaping through outlet valve 26 during expansion. Referring to FIG. 3, reciprocating member 104 then reaches the limit of its upward movement and begins its downward movement. Referring to FIG. 4, as first sealing disk 20 and second sealing disk 22 are moved toward each other by reciprocating member 104 air is forced out of tire 12 through outlet valve 26. During contraction of diaphragm 10, air being expelled forces spring 32 of outlet valve 26 to compress such that valve member 30 of outlet valve 26 is moved out of valve seat 28 so as allow air to exit diaphragm 10 through outlet valve 26. The force of air being expelled forces valve member 30 of inlet valve 24 into valve seat 28 so as to create a seal which prevents air from exiting through inlet valve 24 during contraction of diaphragm 10. The cycle then repeats itself again, as reciprocating member 104 reaches the limit of its downward movement and begins its upward movement. Referring to FIG. 6, the repeated cycle of diaphragm pump 100 makes it suitable for use in conjunction with aerating a pond 140 so as to ensure there is enough oxygen in the water 142 to support fish and other organisms living in pond 140. A pipe 144 is run from outlet valve 26 of diaphragm 10 into pond 140 so that air expelled from diaphragm 10 aerates water 142 in pond 140.

Tires are engineered for use under the most demanding conditions. When a tire is used as a diaphragm for a diaphragm pump, as described above, the life of the diaphragm is dramatically increased.

It is preferred that the output be intermittent, rather than continuous. In the proto-type, a gear reduction unit was used to provide one stroke every five seconds. This appeared to give the best results. Water would flow into the outlet piping between strokes. Air would then displace the water during the pump stroke. This was found to promote better circulation within the pond.

The pump, as described, provides a number of advantages. One advantage is that it is quiet, and avoids the noise pollution that is inherent in other pumping devices. Another advantage is that the use of the device does not introduce oil or lubricants into the pond.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A diaphragm for a diaphragm pump, comprising:

a vehicular tire having a first mounting face, a second mounting face and a circumferential tread portion positioned between first mounting face and the second mounting face;

a first sealing disk secured to the first mounting face of the tire;

a second sealing disk secured to the second mounting face of the tire;

an inlet valve positioned on one of the first sealing disk and the second sealing disk; and an outlet valve positioned on one of the first sealing disk and the second sealing disk.

2. The diaphragm as defined in claim 1, wherein the tire is one of a trailer tire and a wheel barrow tire.

3. A diaphragm pump, comprising:

a housing;

a diaphragm consisting of:

a vehicular tire having a first mounting face, a second mounting face and a circumferential tread portion positioned between first mounting face and the second mounting face;

a first sealing disk secured to the first mounting face of the tire;

a second sealing disk secured to the second mounting face of the tire;

an inlet valve positioned on one of the first sealing disk and the second sealing disk; and an outlet valve positioned on one of the first sealing disk and the second sealing disk;

the second sealing disk being secured to the housing;

a reciprocating member attached to the first sealing disk, the reciprocating member moving the first sealing disk toward and away from the second sealing disk as the reciprocating member reciprocates; and a drive linkage that drives the reciprocating member.

* * * * *